US010535484B2

(12) United States Patent
Fleege

(10) Patent No.: US 10,535,484 B2
(45) Date of Patent: Jan. 14, 2020

(54) NONCONTACT SOLENOID FOR MINIATURE CIRCUIT BREAKERS WITH A MOVABLE FRAME AND MAGNETIC COUPLING

(71) Applicant: Schneider Electric USA, Inc., Andover, MA (US)

(72) Inventor: Dennis W Fleege, Cedar Rapids, IA (US)

(73) Assignee: Schneider Electric USA, Inc., Andover, MA (US)

( * ) Notice: Subject to any disclaimer, the term of this patent is extended or adjusted under 35 U.S.C. 154(b) by 106 days.

(21) Appl. No.: 15/825,801

(22) Filed: Nov. 29, 2017

(65) Prior Publication Data

US 2019/0164710 A1 May 30, 2019

(51) Int. Cl.

| | |
|---|---|
| ***H01H 50/64*** | (2006.01) |
| ***H01H 50/44*** | (2006.01) |
| ***H01H 50/36*** | (2006.01) |
| ***H01H 71/10*** | (2006.01) |
| ***H01H 50/20*** | (2006.01) |
| *H01H 75/10* | (2006.01) |

(52) U.S. Cl.

CPC ..... *H01H 50/64* (2013.01); *H01H 50/20* (2013.01); *H01H 50/36* (2013.01); *H01H 50/44* (2013.01); *H01H 71/10* (2013.01); *H01H 2227/036* (2013.01)

(58) Field of Classification Search

CPC ..... H02H 1/0015; H02H 3/33; H02H 3/334; G01R 31/2801

USPC ..... 335/38

See application file for complete search history.

(56) References Cited

U.S. PATENT DOCUMENTS

| | | | | | |
|---|---|---|---|---|---|
| 1,988,287 | A * | 1/1935 | Thumim | H01H 71/68 | 335/156 |
| 2,323,784 | A * | 7/1943 | Baxter | H01H 71/40 | 335/141 |
| 2,355,075 | A * | 8/1944 | Jensen | H01H 71/50 | 335/24 |
| 2,912,544 | A * | 11/1959 | Piteo, Jr. | H01H 83/12 | 335/20 |
| 2,961,510 | A * | 11/1960 | Baird | H01H 71/504 | 335/13 |
| 3,072,765 | A * | 1/1963 | Taylor | H01H 1/5833 | 335/16 |

(Continued)

FOREIGN PATENT DOCUMENTS

| | | |
|---|---|---|
| EP | 1383144 | 1/2004 |
| GB | 1459298 | 12/1976 |

OTHER PUBLICATIONS

Extended European Search Report for European Patent Application No. 18207979.8 dated Mar. 20, 2019, 5 pages.

(Continued)

*Primary Examiner* — Shawki S Ismail
*Assistant Examiner* — Lisa N Homza
(74) *Attorney, Agent, or Firm* — Locke Lord LLP

(57) ABSTRACT

A touchless magnetic-only coupled solenoid trip system for a miniature circuit breaker achieves magnetic tripping using a floating plunger assembly in a solenoid coil/housing to narrow a magnetic gap between plunger and trip assembly to cause the magnetic trip The floating plunger of the solenoid can also move out of the way if the bimetal bends to cause a thermal trip.

5 Claims, 5 Drawing Sheets

(56) References Cited

U.S. PATENT DOCUMENTS 3,134,871 A * 5/1964 Norden ..... H01H 9/40 218/17
3,198,906 A * 8/1965 Frink ..... H01H 3/30 200/400
3,217,125 A * 11/1965 Brackett ..... H01H 71/16 335/13
3,544,931 A * 12/1970 Patel ..... H01H 71/32 335/174
3,858,130 A * 12/1974 Misencik ..... H01H 71/16 335/18
4,081,852 A * 3/1978 Coley ..... H01H 83/02 335/37
4,085,393 A * 4/1978 Grenier ..... H01H 71/2472 335/202
4,222,019 A * 9/1980 Rusch ..... H01H 71/528 335/202
4,387,356 A * 6/1983 Takemura ..... H01H 71/52 335/21
4,524,339 A * 6/1985 Chabot ..... H01H 1/5833 335/171
4,595,895 A * 6/1986 Fujii ..... H01H 71/526 335/167
4,623,859 A * 11/1986 Erickson ..... H01H 3/38 335/14
4,656,446 A * 4/1987 Chien ..... H01H 1/2066 218/148
4,752,660 A * 6/1988 Yokoyama ..... H01H 9/32 218/117
RE33,400 E * 10/1990 Fujii ..... H01H 71/526 335/167
5,053,735 A * 10/1991 Ohishi ..... H01H 89/08 335/14
5,072,328 A * 12/1991 Dvorak ..... H01H 47/24 335/177
5,093,643 A * 3/1992 Altenhof, Jr. ..... H01H 83/12 335/172
5,103,198 A * 4/1992 Morel ..... H01H 9/50 218/149
5,162,765 A * 11/1992 DiVincenzo ..... H01H 71/2409 335/172
5,180,051 A * 1/1993 Cook ..... H01H 89/08 200/292
5,294,903 A * 3/1994 Bosch ..... H01H 71/526 335/172
5,446,431 A * 8/1995 Leach ..... H01H 71/0214 335/18
5,481,235 A * 1/1996 Heise ..... H01H 83/04 335/18
5,675,303 A * 10/1997 Kelaita, Jr. ..... H01H 71/462 335/172
5,701,110 A * 12/1997 Scheel ..... H01H 1/5805 335/132
5,706,154 A * 1/1998 Seymour ..... H01H 71/36 335/201
5,834,997 A * 11/1998 Fleege ..... H01H 71/70 335/68
5,847,913 A * 12/1998 Turner ..... G01R 31/025 361/93.1
5,861,784 A * 1/1999 Heise ..... H01H 83/20 200/400
5,946,179 A * 8/1999 Fleege ..... G01R 31/025 361/42
6,242,993 B1 * 6/2001 Fleege ..... G01R 31/025 335/18
6,313,723 B1 * 11/2001 Chen ..... H01H 83/20 335/13
6,522,228 B2 * 2/2003 Wellner ..... H01H 71/04 200/317
6,542,056 B2 * 4/2003 Nerstrom ..... H01H 71/04 200/317
6,903,289 B2 * 6/2005 Tongo ..... H01H 73/14 200/310
7,358,838 B2 * 4/2008 Gibson ..... H01H 71/04 335/17
7,378,927 B2 * 5/2008 DiSalvo ..... H01H 71/62 335/18
7,400,477 B2 * 7/2008 Campolo ..... H01H 71/62 335/21
7,405,640 B2 * 7/2008 McCoy ..... H01H 71/04 335/172
7,414,498 B2 * 8/2008 McCoy ..... H01H 71/04 335/172
7,715,158 B2 * 5/2010 Bonasia ..... H02H 3/338 361/42
8,369,052 B2 * 2/2013 McCoy ..... H01H 71/1018 361/115
9,048,054 B2 * 6/2015 Potratz ..... H01H 83/02
9,058,939 B2 * 6/2015 Mittelstadt ..... H01H 9/46
2003/0201857 A1 * 10/2003 O'Keeffe ..... H01H 71/2463 335/172
2004/0196123 A1 * 10/2004 Simms ..... H01H 1/54 335/6
2010/0156576 A1 * 6/2010 Broghammer ..... H01H 71/162 335/35
2011/0019387 A1 * 1/2011 De Geus ..... H01F 38/28 361/836
2011/0115585 A1 * 5/2011 Fleege ..... H01H 83/226 335/10
2016/0189900 A1 6/2016 Beauregard et al.

OTHER PUBLICATIONS

English Language Machine Translation of European Patent Application Publication No. EP1383144, published Jan. 21, 2004, 12 pages.

* cited by examiner

NONCONTACT SOLENOID FOR MINIATURE CIRCUIT BREAKERS WITH A MOVABLE FRAME AND MAGNETIC COUPLING

BACKGROUND

1. Field of the Invention

The present invention relates generally to magnetically actuated devices and particularly to miniature circuit breakers (MCBs) which utilize a solenoid in the trip mechanism.

2. Discussion of the Known Art

Known circuit breaker products which utilize a solenoid in their trip mechanism typically use a movable solenoid plunger that is mechanically linked to the normal thermal/magnetic/electronic tripping system. These systems typically have a plunger arm in the solenoid that is captured therein and operates to press against or pull on a yoke mechanism of the trip assembly which typically includes at least the yoke, its associated latch plate, and a thermal trip bimetal; thereby delatching the trip lever and separating the movable contact from the stationary contact to remove power from the load. There are also known arrangements of magnetic-only coupled tripping solenoids where the plunger arm does not physically contact the trip assembly but instead acts upon it magnetically because the yoke or latch plate is ferromagnetic. Alternative solenoid arrangements from those known in the art may be desirable for a variety of reasons, especially in electronic miniature circuit breakers where physical space for components is at a premium.

Typically, NEMA-style miniature circuit breaker construction has the contact make or break mechanism, i.e. the trip lever and bias springs of the movable contact, on the high-expansion side of the bimetal, so that during fault conditions, the free end of the bimetal moves away from the contact make or break mechanism to disengage the circuit breaker latch. This arrangement is continued in some known MCBs with magnetic-only coupled tripping solenoids placed on the high expansion side of the bimetal, where the solenoid competes for room in the breaker with the contact make or break mechanism. Therefore either the solenoid or the make or break mechanism, or both, must be limited in size and may need to be made smaller than is considered ideal to withstand the voltage surge requirements for a miniature circuit breaker. Thus in existing systems an additional component, usually a relatively large MOV, is added to achieve the function of withstanding the required voltage surge. Accordingly, there is room for improvement in such systems.

SUMMARY

The present invention provides an alternative miniature circuit breaker trip system with a magnetic-only coupling tripping solenoid with a moveable plunger assembly. The magnetic-only coupled plunger assembly has a floating plunger and frame that allows the magnetic gap between the solenoid and the yoke to be as small as possible, but lets the bimetal used for overcurrent thermal tripping move freely during short circuits to its full deflection by moving the plunger assembly of the solenoid out of its way. This aspect of the present invention allows a reduction of the physical and magnetic distance between the yoke and the trip solenoid with moveable frame and increases the magnetic attraction force between them. The floating plunger assembly can be in the forward or rearward position before the solenoid is energized. Thus, after the solenoid is energized a stronger pulling force is provided to move the trip assembly yoke and its attached latch plate, to de-latch the trip lever and trip the breaker, while the floating plunger is also movable to allow full deflection of the bimetal in a thermal trip condition. The present design also offers more flexibility in the positioning of the tripping solenoid than known systems and helps in the layout and assembly of the breaker by providing more possible positions in the limited space of the miniature circuit breaker.

In one aspect of the present invention a circuit breaker trip mechanism is presented, comprising: a trip assembly including a ferromagnetic yoke and a latch plate attached to the yoke; a trip lever held in the latch plate; a solenoid with a coil and a housing for the coil, and a plunger assembly of ferromagnetic material with a frame and a plunger rod attached to the frame, and the plunger rod passing through and floating in the solenoid coil when the solenoid is not activated; and the solenoid coil mounted adjacent to the ferromagnetic yoke at a known distance; whereby activating the solenoid pulls the frame to the housing of the solenoid coil thus placing the plunger rod at a magnetic gap distance from the trip assembly sufficient to magnetically attract the at least one of the ferromagnetic yoke and the latch plate to delatch the trip lever and trip the breaker. In another aspect of the present invention the circuit breaker trip mechanism may include the frame and plunger rod being integrated into a single piece. In another aspect of the present invention the circuit breaker trip mechanism may include the frame being U-shaped. In another aspect of the present invention the circuit breaker trip mechanism may include the frame and plunger rod being formed from a single material. In another aspect of the present invention the circuit breaker trip mechanism may further include a bimetal within the yoke, the plunger assembly facing the direction of yoke movement during a bimetal trip, and wherein the plunger assembly will yield under a motion of the bimetal causing a trip event.

BRIEF DESCRIPTION OF THE DRAWINGS

The foregoing and other advantages of the disclosed embodiments will become apparent upon reading the following detailed description and upon reference to the drawings, wherein.

DETAILED DESCRIPTION

As an initial matter, it will be appreciated that the development of an actual commercial application incorporating aspects of the disclosed embodiments will require many implementation specific decisions to achieve the developer's ultimate goal for the commercial embodiment. Such implementation specific decisions may include, and likely are not limited to, compliance with system related, business related, government related and other constraints, which may vary by specific implementation, location and from time to time. While a developer's efforts might be complex and time consuming in an absolute sense, such efforts would nevertheless be a routine undertaking for those of skill in this art having the benefit of this disclosure.

It should also be understood that the embodiments disclosed and taught herein are susceptible to numerous and various modifications and alternative forms. Thus, the use of a singular term, such as, but not limited to, "a" and the like, is not intended as limiting of the number of items. Similarly, any relational terms, such as, but not limited to, "top," "bottom," "left," "right," "upper," "lower," "down," "up," "side," and the like, used in the written description are for clarity in specific reference to the drawings and are not intended to limit the scope of the invention.

Further, words of degree, such as "about," "substantially," and the like may be used herein in the sense of "at, or nearly at, when given the manufacturing, design, and material tolerances inherent in the stated circumstances" and are used to prevent the unscrupulous infringer from unfairly taking advantage of the invention disclosure where exact or absolute figures and operational or structural relationships are stated as an aid to understanding the invention.

Figure 1:
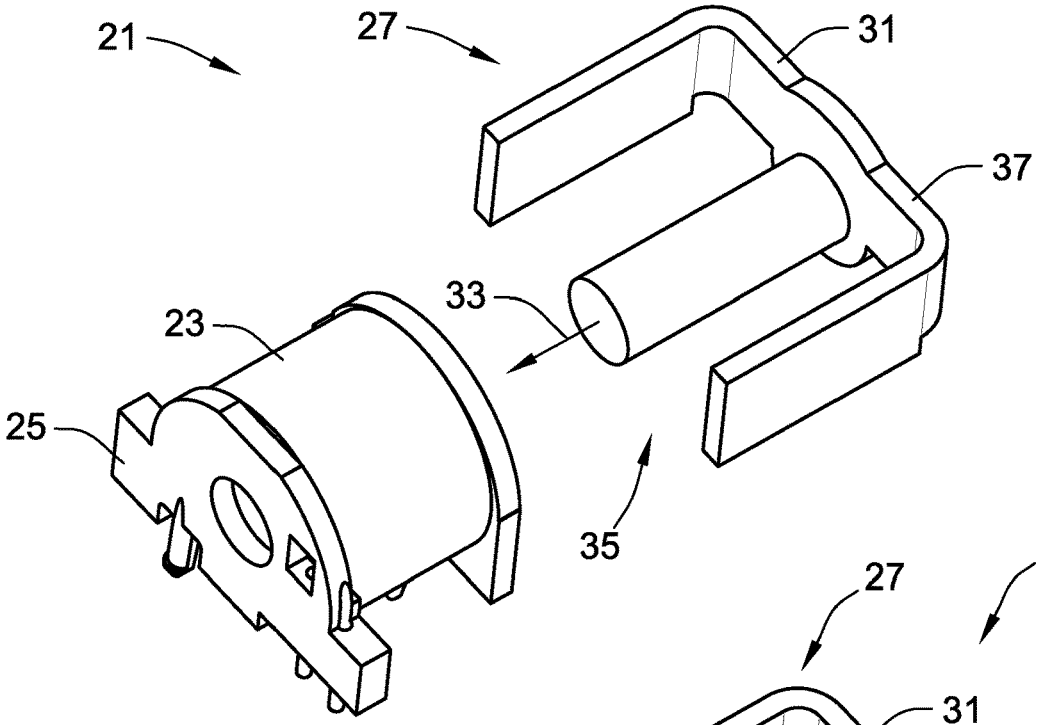
FIG. 1 is a perspective view of plunger assembly showing the separated solenoid coil and housing and integrated plunger and frame with an arrow indicating assembly direction.

FIG. 1 is a perspective view of a solenoid 21 showing the solenoid coil 23 and housing 25 separated from a plunger assembly 27 with an integrated plunger rod 29 and U-shaped frame 31 with an arrow 33 indicating assembly direction. The U-shaped frame 31 has an open end 35 and a closed end 37. The plunger rod 29 is attached to the closed end 37 of the frame 31. Preferably the frame 31 and the plunger rod 29 are both made of ferromagnetic material. While described here as a "U"-shape, the frame could be any shape capable of supporting the plunger rod and allowing magnetic functioning of the solenoid. For example the frame 31 might be an "L"—shape, a plate shape, or be a basically cylindrical housing.

Figure 2:
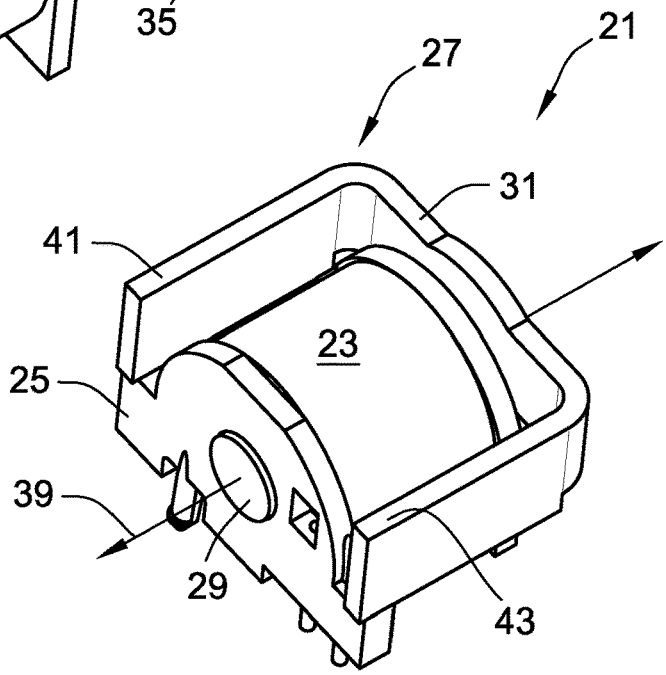
FIG. 2 is a perspective view of the solenoid coil and housing with integrated plunger and frame therein in an inactive resting position with an arrow indicating the plunger assembly is free to move in either direction.

FIG. 2 shows the assembled plunger assembly 27 wherein the plunger rod 29 is inserted through the coil 23 and floating freely therein, free to move in either direction, as indicated by arrow 39 when the solenoid 21 is inactive, i.e. no current is flowing in the coil 23. The upper arm 41 and lower arm 43 of the frame 31 rest on the housing 25 of the coil 23.

Figure 3:
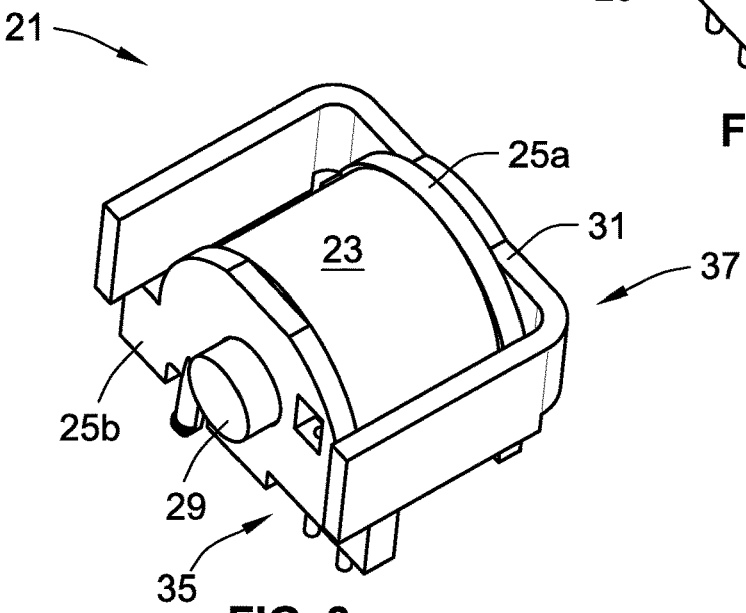
FIG. 3 is a perspective view of the solenoid coil and housing with integrated plunger and frame pulled into an active position with the frame of the integrated plunger assembly against the coil and the plunger in position to shorten the magnetic gap with the yoke.

FIG. 3 shows the solenoid in an active state, i.e. current is flowing in the coil 23 creating a magnetic field pulling the closed end 37 of the frame 31 flush against the rear housing 25*a*, in a position sometimes called "magnetic center" herein, causing the plunger rod 29 to extend through the coil 23 and beyond the forward housing 25*b* at the open end 35 of the frame 31.

Figure 4:
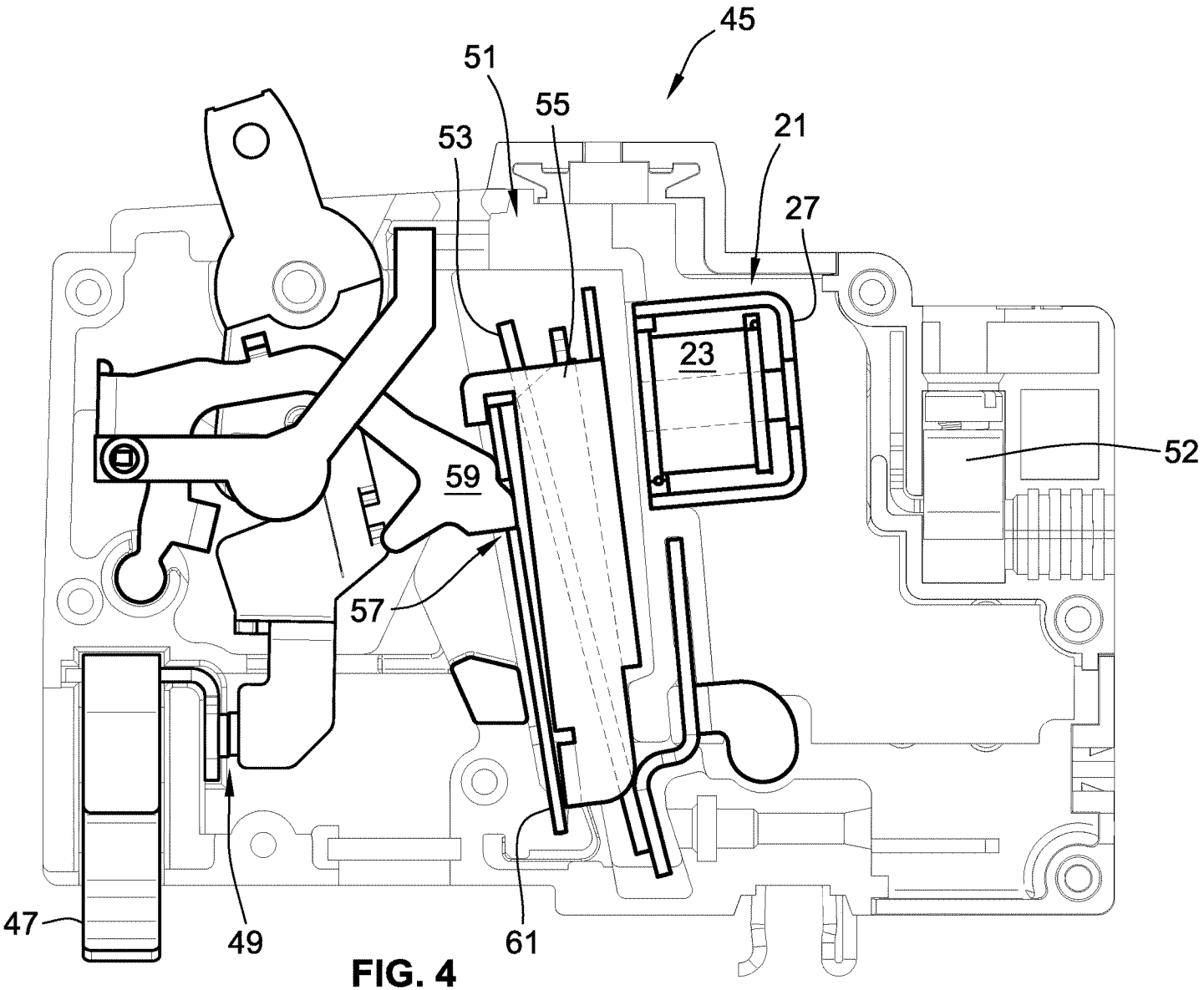
FIG. 4 shows a miniature circuit breaker in a latched position with the inactive solenoid having the plunger assembly free to float in the coil.
Figure 6:
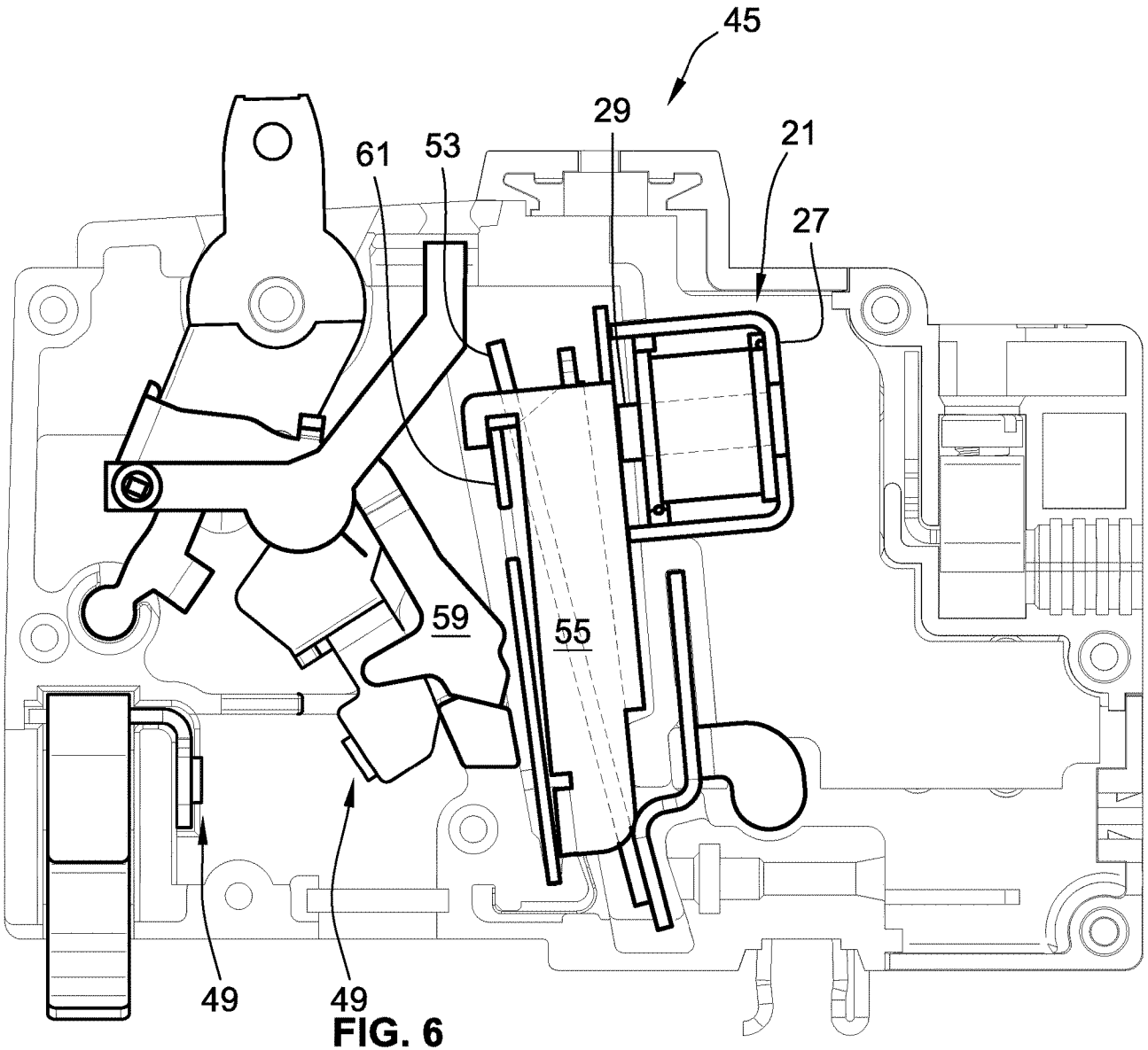
FIG. 6 shows the gap between the plunger and the yoke being reduced with the yoke and trip assembly latch plate magnetically pulled in the direction of the solenoid. This movement causes the trip assembly latch plate to de-latch from the trip lever and causes the breaker to move to a tripped state.

FIG. 4 shows a miniature circuit breaker 45 in a reset/latched position with the solenoid 21 having the plunger assembly free 27 to float in the coil 23 as far as features in the cover (not shown) will allow it to move in the right side direction. As with the basics of a known circuit breaker of e.g. the Dual Function Arc Fault/Ground Fault Circuit Interrupter type, the line current path of the breaker 45 starts at the line power terminal 47 of the breaker 45 and continues through the separable contacts 49 to the load terminal 52 which is wired out to the branch load (not shown). The circuit breaker 45 contains thermal and magnetic trip units 51, i.e. a bimetal 53 and a magnetic yoke 55 assembly, respectively, which are components for initiating the tripping of the breaker, i.e. separating of the contacts 49, in the event of overcurrent conditions. The incoming current path of the breaker 45 contains a latch 57 which operates the separable contacts 49 by either of the thermal/magnetic trip assembly 51 or the solenoid 21. The latching mechanism 57 for a trip event comprise the spring-biased trip lever 59 anchored in the latch plate 61 connected to magnetic yoke 55 when the separable contacts collectively 49 are together. Separating the latch plate 61 from the trip lever 59 causes the trip event, i.e. separation of the separable contacts. As seen in FIG. 6, once the trip lever 59 separates from the latch plate 61, the free end of the trip lever 59 is pulled downward by a spring bias allowing the contacts 49 to separate.

As understood in the art, for an electronic trip, the solenoid 21 is operated by the electronics (not shown) such as for AFCI/GFCI protection. For a thermal trip, within the yoke 55 is a bimetal 53 whose distortion under heat forces the latch plate 61 away from the trip lever 59.

Figure 5:
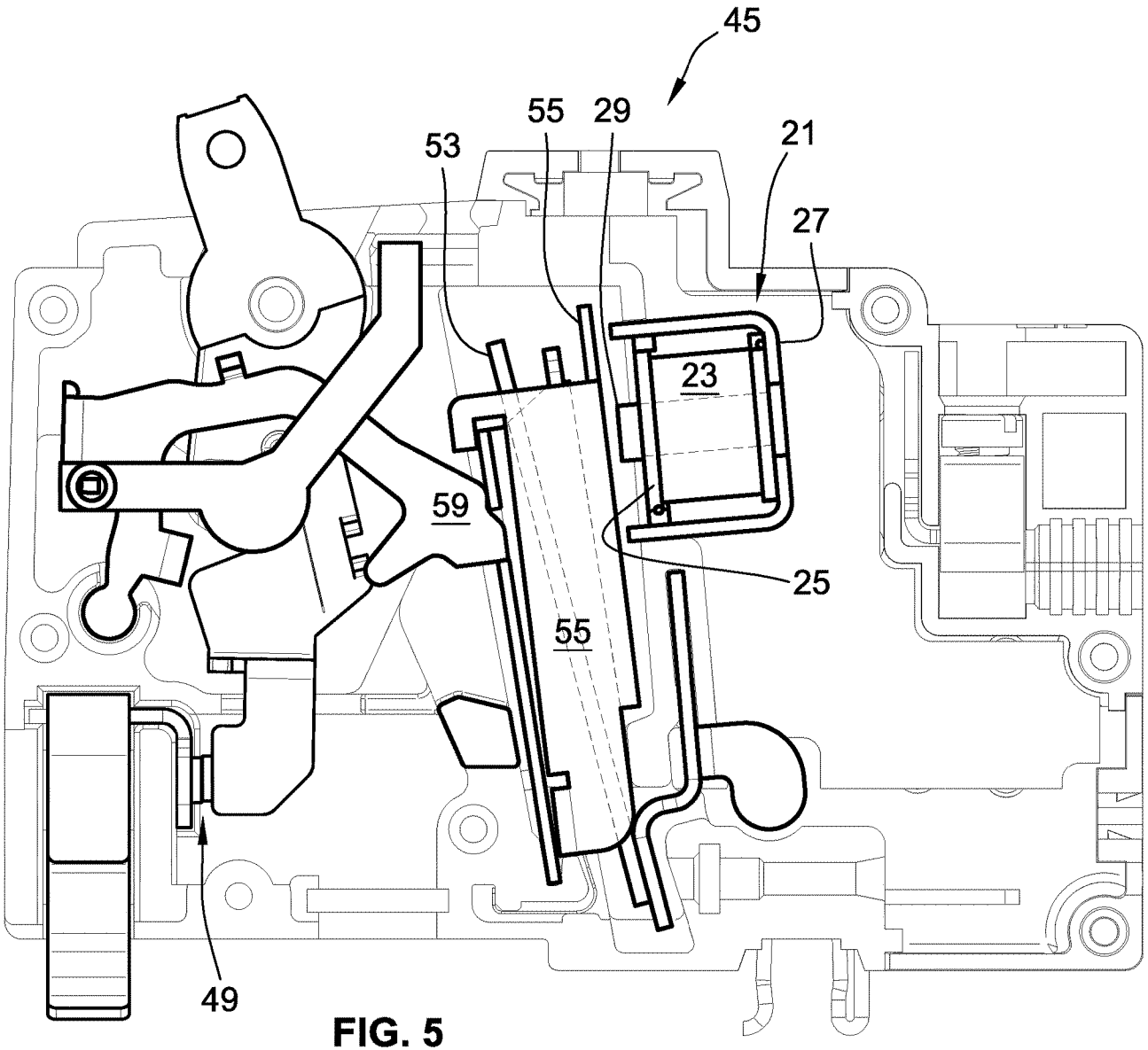
FIG. 5 shows the solenoid in an energized state with the plunger assembly biased in the direction of magnetic center with the solenoid thus reducing the gap between the plunger and the yoke.

As seen in FIG. 5 the solenoid 21 is in an energized state with the plunger assembly 27 biased in the direction of magnetic center with the solenoid 21 thus reducing the magnetic gap between the plunger rod 29 and the yoke 55 to the point where the ferromagnetic yoke 55 will be attracted toward the magnetized plunger rod 29 to initiate the trip event.

FIG. 6 shows the reduced magnetic gap between the plunger rod 29 and the yoke 55 has pulled the yoke 55 and its attached latch plate 61 in the direction of the solenoid 21. This movement causes the trip lever 59 to de-latch from the latch plate 61 and causes the breaker 45 to move to a tripped state with separated contacts 49. It will be appreciated that the magnetic force of the solenoid plunger rod 29 could be made to directly attract the latch plate 61 in some embodiments depending on the arrangement of the parts.

Figure 7:
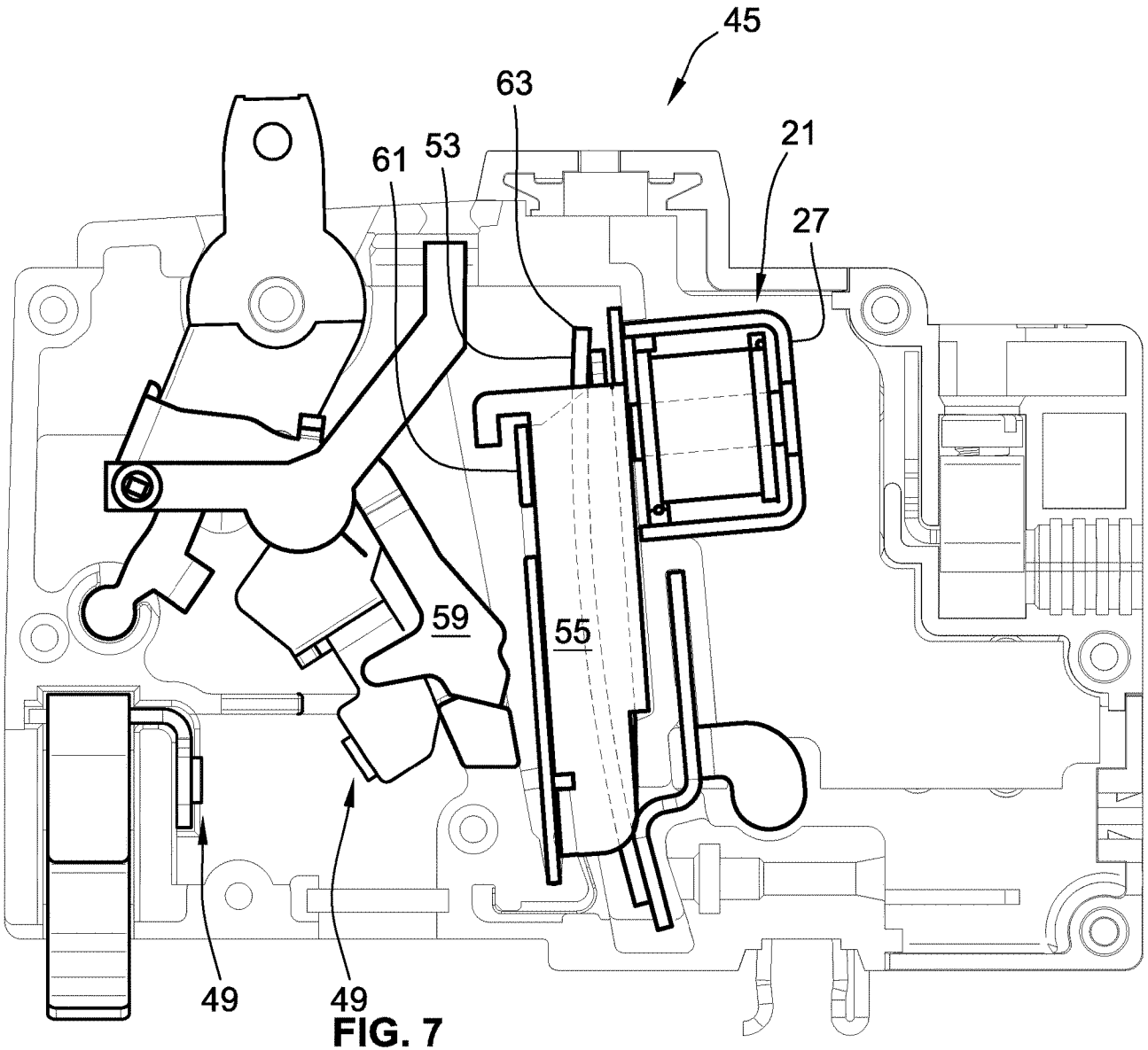
FIG. 7 shows the breaker in a thermally tripped position caused by the bimetal.

FIG. 7 shows the breaker 45 in a thermally tripped position caused by the free end 63 of the bimetal 53 bending from left to right due to overcurrent heating and pulling the yoke/latch plate away from the trip lever 59. The movement of the bimetal 53 can be larger than the distance that the magnetics of the solenoid trip work within. With the plunger assembly 27 free to float within the solenoid 21, the bimetal 53 can push the yoke which movement will push the plunger assembly 27 to the right allowing the bimetal 53 to move without being stopped under stress, thus reducing the chances of the bimetal taking a set.

While particular aspects, implementations, and applications of the present disclosure have been illustrated and described, it is to be understood that the present disclosure is not limited to the precise construction and compositions disclosed herein and that various modifications, changes, and variations may be apparent from the foregoing descriptions without departing from the invention as defined in the appended claims.

The invention claimed is:

1. A circuit breaker trip mechanism comprising:

a trip assembly including a ferromagnetic yoke and a latch plate attached to the yoke;

a trip lever held in the latch plate;

a solenoid with a coil and a housing for the coil, and a plunger assembly of ferromagnetic material with a movable frame and a plunger rod attached to the frame, and the plunger rod passing through and floating in the solenoid coil when the solenoid is not activated;

and the solenoid coil mounted adjacent to the ferromagnetic yoke at a known distance;

whereby activating the solenoid pulls the frame to the housing of the solenoid coil in a direction toward the trip assembly thus placing the plunger rod at a magnetic gap distance from the trip assembly sufficient to magnetically attract the at least one of the ferromagnetic yoke and the latch plate to delatch the trip lever and trip the breaker.

2. The circuit breaker trip mechanism according to claim 1 wherein the frame and plunger rod are integrated into a single piece.

3. The circuit breaker trip mechanism according to claim 1 wherein the frame is U-shaped.

4. The circuit breaker trip mechanism according to claim 1 wherein the frame and plunger rod are formed from a single material.

5. The circuit breaker trip mechanism according to claim 1 further including a bimetal within the trip assembly, the plunger assembly facing the direction of yoke movement during a bimetal trip, and wherein the plunger assembly will yield under a motion of the bimetal causing a trip event.

* * * * *